US007651445B1

(12) United States Patent
Chen

(10) Patent No.: US 7,651,445 B1
(45) Date of Patent: Jan. 26, 2010

(54) ELLIPTICAL TRAINER

(76) Inventor: I-Huang Chen, No. 66, Alley 71, Lane 252, Sec. 2, Jieshou Rd., Pateh City, Taoyuan Hsien (CN)

( * ) Notice: Subject to any disclaimer, the term of this patent is extended or adjusted under 35 U.S.C. 154(b) by 0 days.

(21) Appl. No.: 12/247,271

(22) Filed: Oct. 8, 2008

(51) Int. Cl.
*A63B 22/00* (2006.01)
*A63B 22/04* (2006.01)

(52) U.S. Cl. ..... 482/52; 482/51; 482/57

(58) Field of Classification Search ..... 482/51–53, 482/57, 62, 70, 79–80
See application file for complete search history.

(56) References Cited

U.S. PATENT DOCUMENTS 5,957,814 A * 9/1999 Eschenbach ..... 482/51
6,482,132 B2 * 11/2002 Eschenbach ..... 482/52
6,949,054 B1 * 9/2005 Stearns et al. ..... 482/52
7,060,005 B2 * 6/2006 Carlsen et al. ..... 482/52
7,462,136 B2 * 12/2008 Pan et al. ..... 482/52
7,485,080 B1 * 2/2009 Chuang et al. ..... 482/142
7,530,926 B2 * 5/2009 Rodgers, Jr. ..... 482/52

* cited by examiner

*Primary Examiner*—Steve R Crow
(74) *Attorney, Agent, or Firm*—Fitch, Even, Tabin & Flannery

(57) ABSTRACT

An elliptical trainer has a base, a flywheel, two four-bar linkages and two handles. The base has a bottom frame and a support mounted on the bottom frame. The four-bar linkages are mounted pivotally on the support and each four-bar linkage has a front link, a rear link, an upper coupler and a lower link. The handle assemblies are mounted pivotally on the support and pivotally connected respectively to the four-bar linkages. Because the four-bar linkages and the handle assemblies are structured compact and simple, fabrication, carrying and maintenance of the elliptical trainer are convenient.

7 Claims, 6 Drawing Sheets

ELLIPTICAL TRAINER

BACKGROUND OF THE INVENTION

1. Field of the Invention

The present invention relates to a trainer, and more particularly to an elliptical trainer that is simply structured and efficiently operated to provide a user with a non-impact cardiovascular workout.

2. Description of Related Art

Elliptical trainers are stationary exercise machines used to simulate walking or running without causing excessive pressure to the knee joints to decrease the risk of impact injuries.

Elliptical trainers offer a non-impact cardiovascular workout capable of varying from light to high intensity based on the resistance preference set by users. Most elliptical trainers work the user's upper and lower body. Generally, elliptical trainers are designed to provide a cardiovascular workout rather than building muscles.

However, conventional elliptical trainers are structured complicated and operating inefficiently.

To overcome the shortcomings, the present invention provides an elliptical trainer to mitigate or obviate the aforementioned problems.

SUMMARY OF THE INVENTION

The main objective of the invention is to provide an elliptical trainer that is simply structured and efficiently operated to provide a user with a non-impact cardiovascular workout.

An elliptical trainer in accordance with the present invention comprises a base, a flywheel, two four-bar linkages and two handles. The base has a bottom frame and a support mounted on the bottom frame. The four-bar linkages are mounted pivotally on the support and each four-bar linkage has a front link, a rear link, an upper coupler and a lower link. The handle assemblies are mounted pivotally on the support and pivotally connected respectively to the four-bar linkages. Because the four-bar linkages and the handle assemblies are structured compact and simple, fabrication, carrying and maintenance of the elliptical trainer are convenient.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
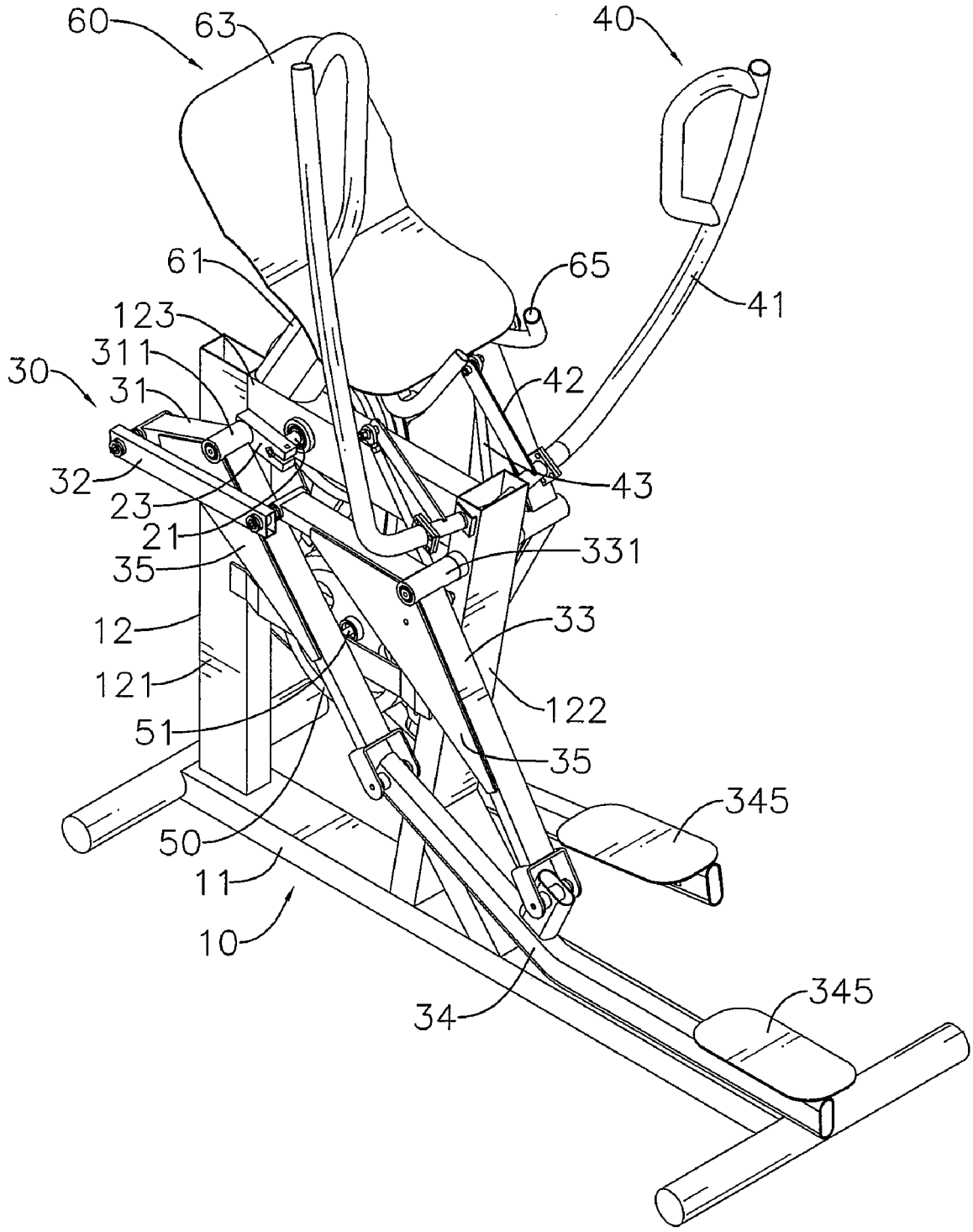
FIG. 1 is a perspective view of the elliptical trainer in accordance with the present invention.
Figure 2:
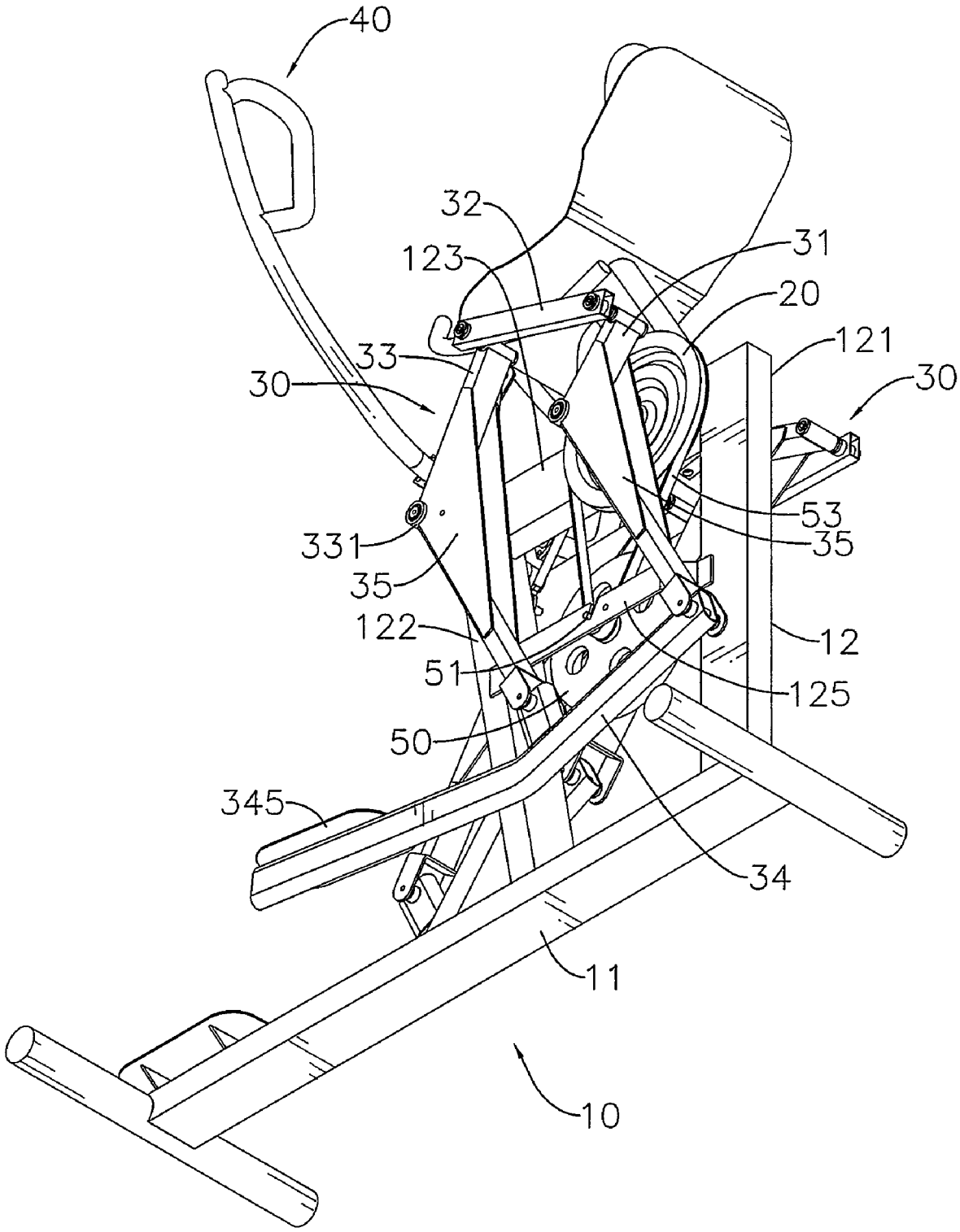
FIG. 2 is another perspective view of the elliptical trainer in FIG. 1.

With reference to FIGS. 1 and 2, an elliptical trainer has a base (10), a flywheel (20), two four-bar linkages (30) and two handle assemblies (40) and may further have a magnetic wheel (50) and a control panel assembly (60).

The base (10) has a bottom frame (11) and a support (12).

The bottom frame (11) is longitudinal and has a front end, a rear end and may further have two foot rods (111). The foot rods are transversely mounted respectively on the front and rear ends and may be placed on the ground.

The support (12) is reversed U-shaped, is mounted on and protrudes up from the bottom frame (11) near the front end, has two opposite sides and may have a front frame (121), a front frame (122), a top frame (123) and two opposite brackets (125). The front frame (121) and rear frame (122) are mounted on and protrude upwards from the bottom frame (11). The top frame (123) is mounted between the front frame (121) and rear frame (122). The brackets (125) are longitudinal and are mounted between the front and rear frames (121, 122) below the top frame (123).

Figure 3:
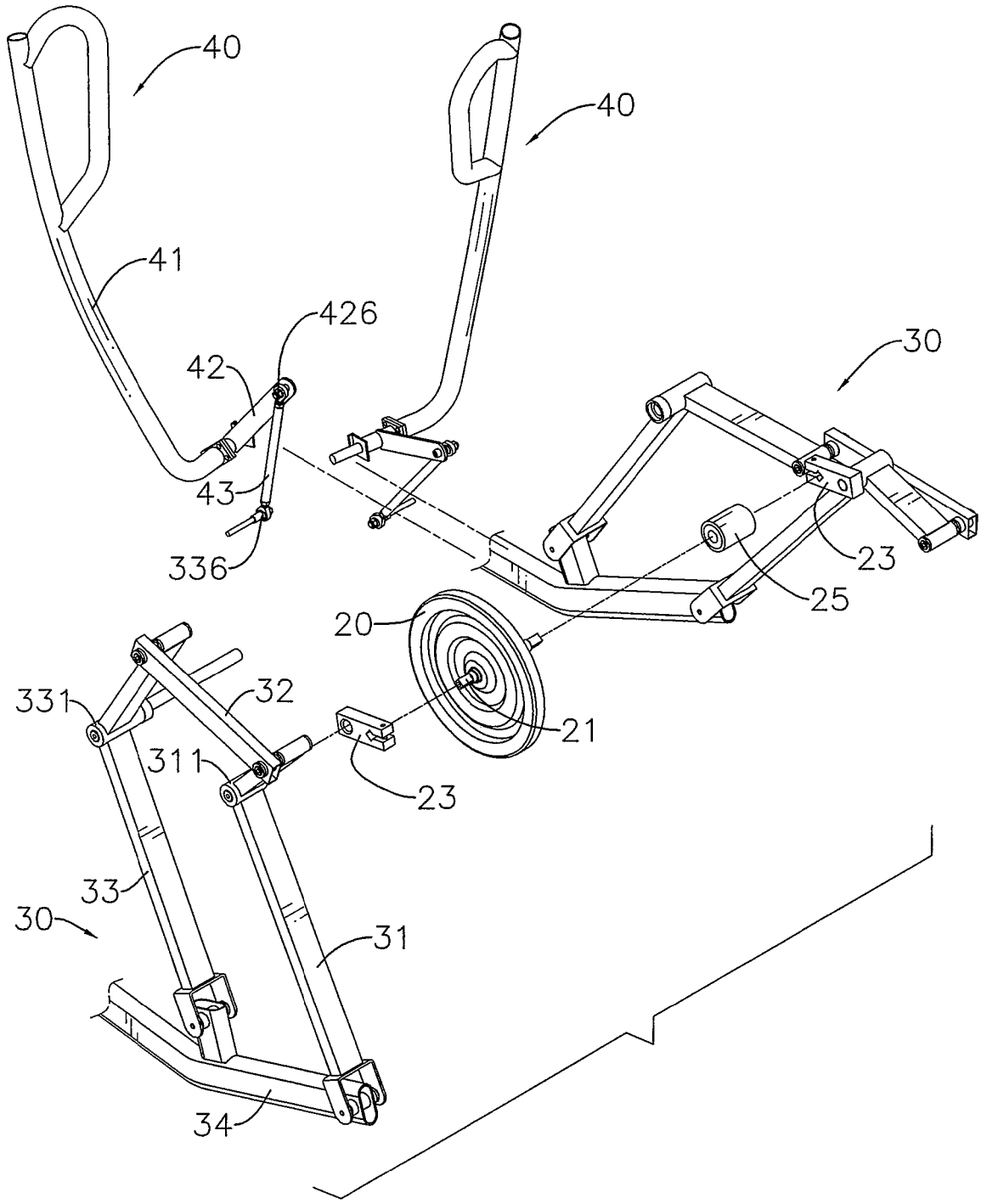
FIG. 3 is an partially exploded perspective view of the flywheel, the four-bar linkages and the handle assemblies of the elliptical trainer in FIG. 2.

With further reference to FIG. 3, the flywheel (20) may be made of metal, is mounted rotatably on one side of the support (12) of the base (10), may be mounted on the top frame (123), has an axle (21) and two cranks (23) and may further have a bearing (25).

The axle (21) is mounted axially and securely through the flywheel (20), is mounted rotatably through the support (12), may be mounted rotatably through the top frame (123) and has two ends.

The cranks (23) are securely and radially mounted respectively on the ends of the axle (21) and each crank (23) has an inner end and an outer end. The inner end is mounted securely on the axle (21).

The bearing (25) may be a ball bearing, is mounted securely in the top frame (123) and rotatably receives the axle (21).

Figure 4:
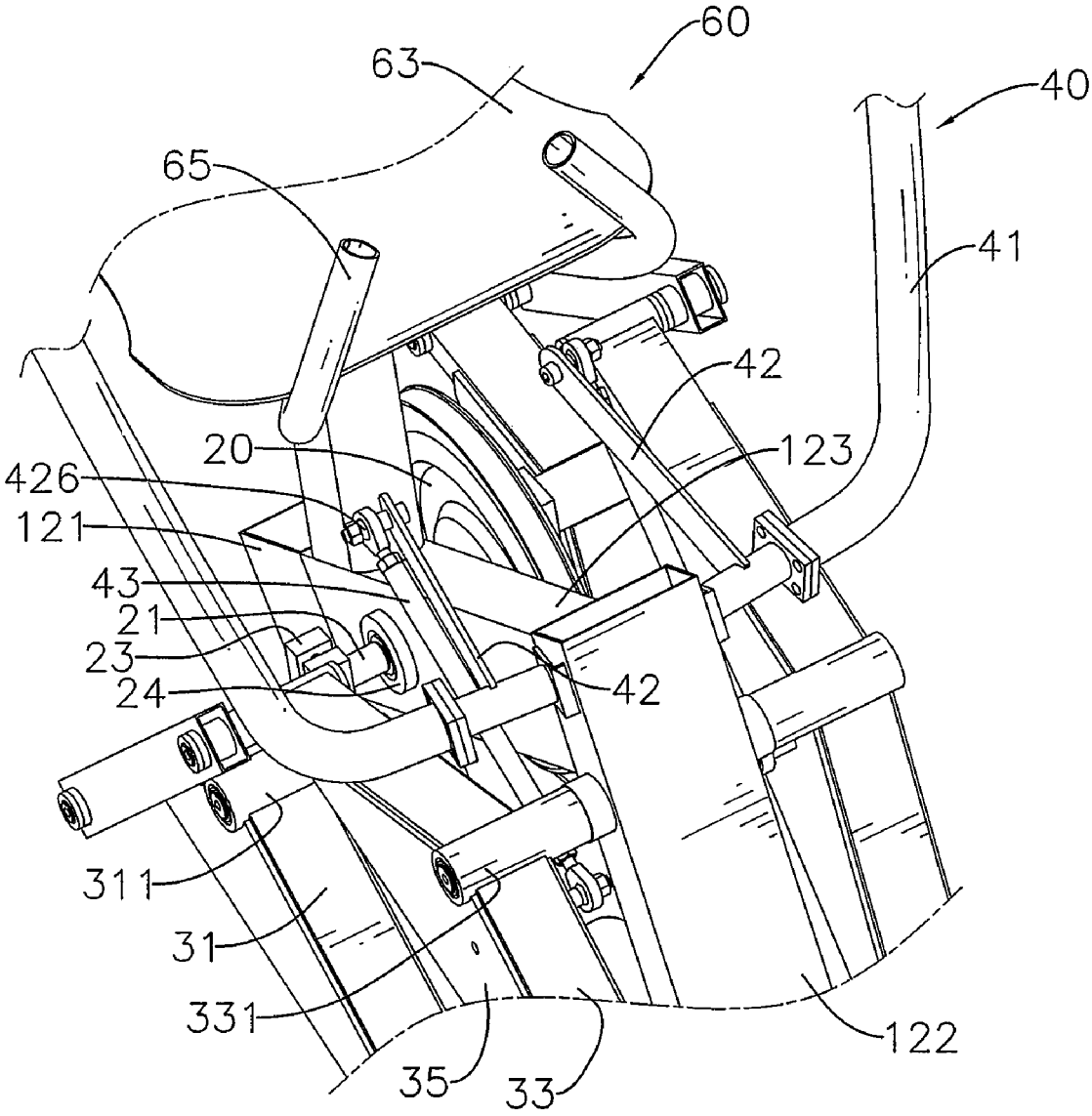
FIG. 4 is a partially enlarged perspective view of the elliptical trainer in FIG. 1.
Figure 5:
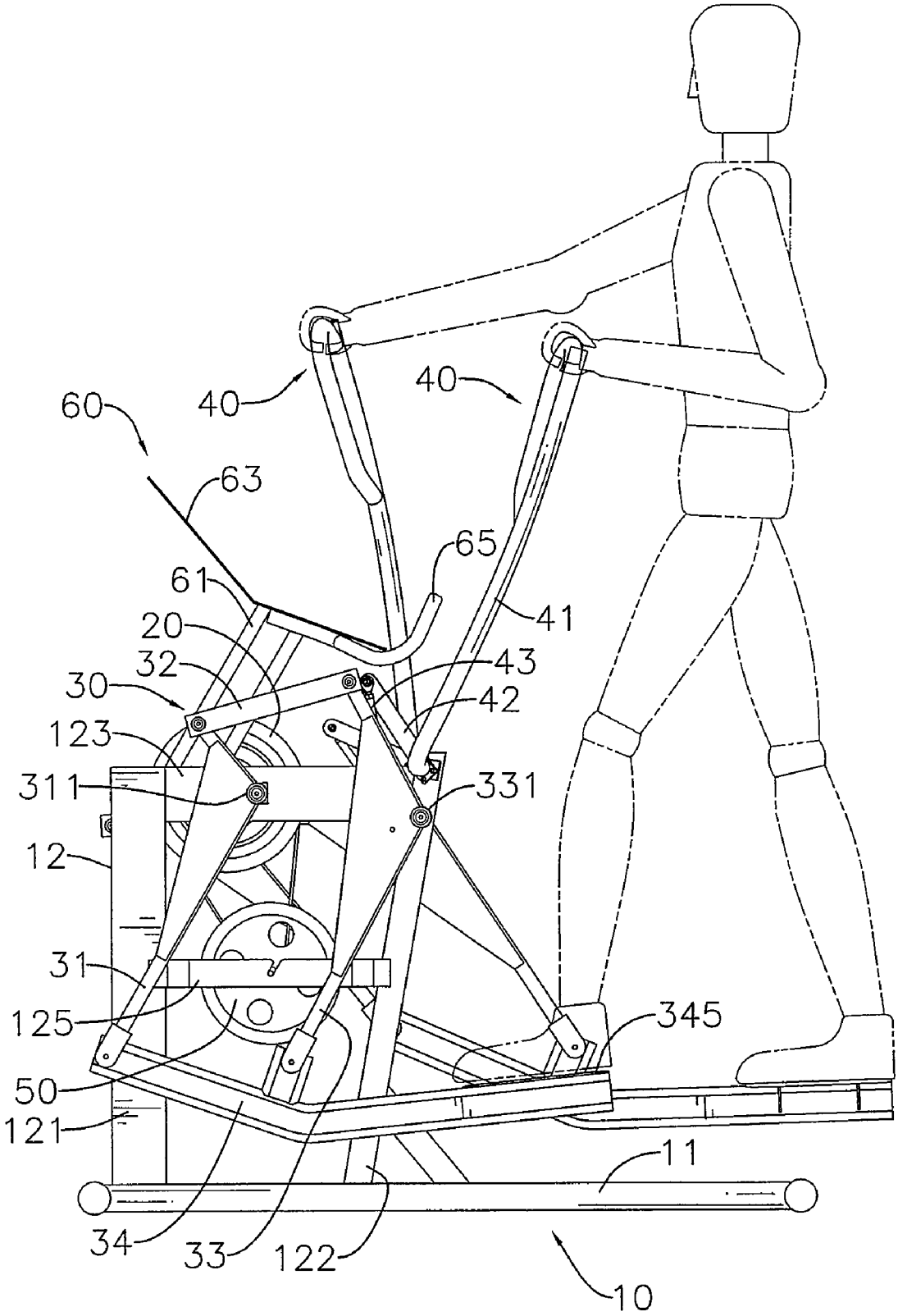
FIG. 5 is an operational side view of the elliptical trainer in FIG. 1 showing a user exercising thereon.
Figure 6:
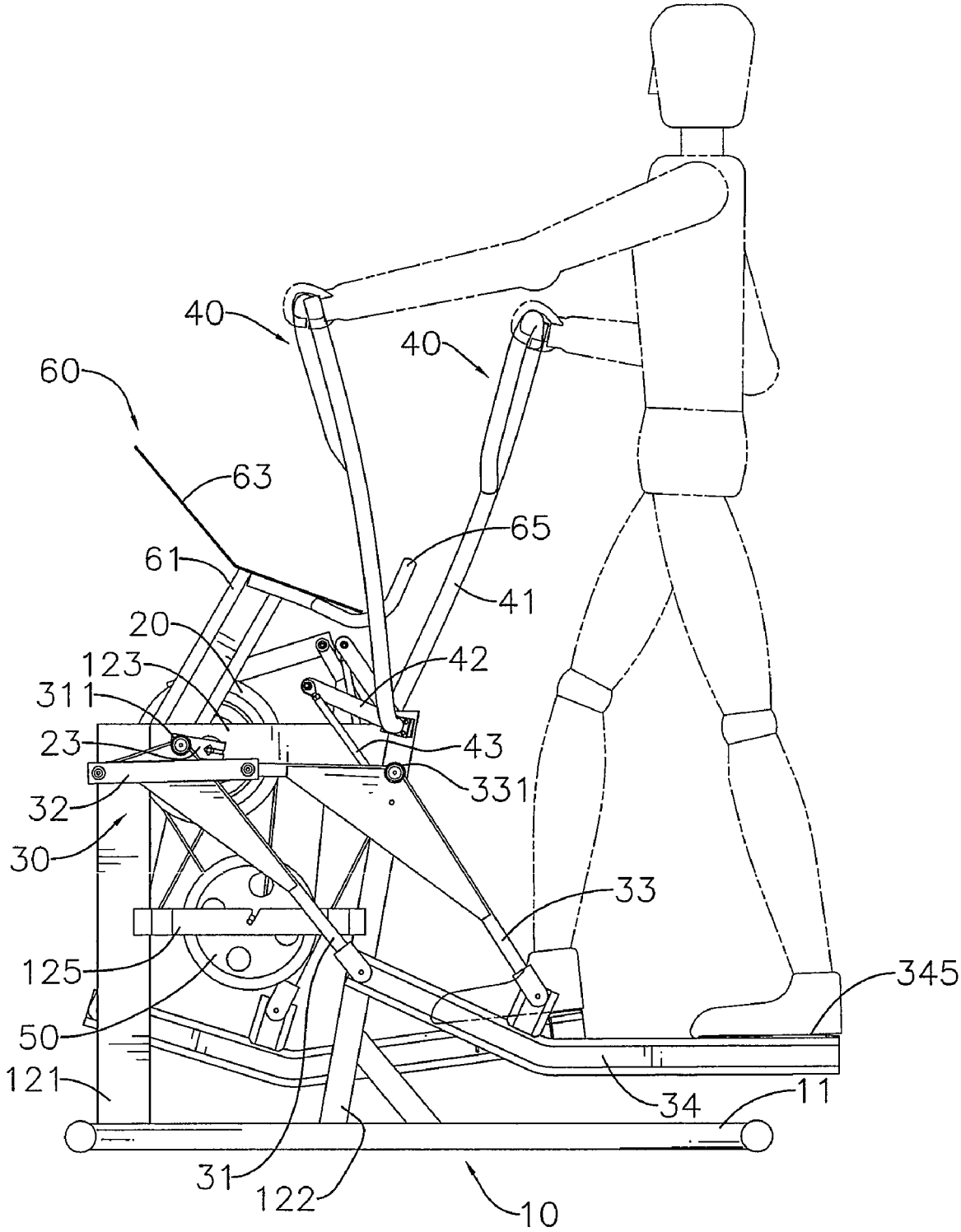
FIG. 6 is an operational side view of the elliptical trainer in FIG. 4.

With further reference to FIGS. 4-6, the four-bar linkages (30) are pivotally connected respectively on the opposite sides of the support (12) of the base (10) and are pivotally connected eccentrically to the flywheel (20). Each four-bar linkage (30) has a front link (31), a rear link (32), an upper coupler (32) and a lower link (34).

The front link (31) may be angled, is mounted pivotally on the support (12) of the base (10), has an upper end, a lower end and an intermediate pivot (311) and may further have two opposites covering plates (35). The intermediate pivot (311) is formed between the upper end and the lower end and is mounted rotatably on the outer end of one of the cranks (23) of the flywheel (20) so that rotating the flywheel (20) eccentrically moves the intermediate pivot (311). The covering plates (35) are triangular and are mounted on the front link (31).

The rear link (33) may be angled, is mounted pivotally on the support (12) of the base (10) and has an upper end, a lower end, an intermediate pivot (331) and a lower joint (336) and may further have two opposites covering plates (35). The intermediate pivot (331) is formed between the upper end and the lower end of the rear link (33), is mounted rotatably on the support (12) and may be mounted rotatably on the rear frame (122). The lower joint (12) is mounted securely on the rear link (33) and may be a ball joint. The covering plates (35) are triangular and are mounted on the rear link (33) and securely hold the lower joint (336) by mounting the lower joint (336) through the covering plates (35).

The upper coupler (32) is connected pivotally between the upper ends of the front and rear links (31, 33).

The lower link (34) is longitudinal, is connected pivotally to the lower ends of the front and rear links (31, 33) and protrudes backwards from the lower end of the rear link (33).

The lower link (34) has a rear end and may further have a footrest pedal (345) mounted securely on the rear end of the lower link (34).

The handle assemblies (40) are mounted pivotally on the support (12) of the base (10) and are pivotally connected respectively to and correspond respectively to the rear links (33). Each handle assembly (40) has a handle (41), a linking bar (42) and a connection link (43).

The handle (40) is longitudinal, is mounted pivotally on the support (12) and may be mounted pivotally on the rear frame (33).

The linking bar (42) is formed on and protrudes perpendicularly from the handle (40) and has an upper joint (426). The upper joint (426) is mounted securely on the linking bar (42) and may be a ball joint.

The connecting rod (43) is connected pivotally between the upper joint (426) and the lower joint (336) of a corresponding rear link (33) and may have two ends and two mounting holes defined respectively through the ends and rotatably and respectively receiving the ball joints of the linking bar (42) and the corresponding rear link (33).

The magnetic wheel (50) is mounted rotatably on the brackets (125) of the support (12) of the base (10) to damp the rotation of the flywheel (20) and has a pivot shaft (51) and a belt (53). The pivot shaft (51) is mounted on the support (12) and may be mounted on the brackets (125). The belt (53) is looped, is mounted around the flywheel (70) and the pivot shaft (51).

The control panel assembly (60) is mounted on the securely on the support (12) of the base (10), controls and monitors the rotation of the flywheel (20) and the magnetic wheel (50) and has a post (61), a control panel (63) and two stationary grips (65).

The post (61) is mounted securely on the top frame (123) of the support (123).

The control panel (63) is mounted on the post (61) and may have a monitor, a microprocessor and a control circuit connected electrically to the flywheel (20) and magnetic wheel (50). The stationary grips (65) are mounted securely on the control panel (63) so that a user may rest his/her hands on the stationary grips (65) during the exercising.

Because the four-bar linkages (30) and the handle assemblies (40) are structured compact and simple, fabrication, carrying and maintenance of the elliptical trainer are convenient.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An elliptical trainer comprising:

a base having a bottom frame having a front end and a rear end; and a support mounted on and protruding up from the bottom frame near the front end and having opposite sides;

a flywheel mounted rotatably on one side of the support of the base and having an axle mounted axially and securely through the flywheel, mounted rotatably through the support and having two ends; and two cranks securely and radially mounted respectively on the ends of the axle and each crank having an inner end mounted securely on the axle and an outer end;

two four-bar linkages pivotally connected respectively on the opposite sides of the support of the base and pivotally connected eccentrically to the flywheel, and each four-bar linkage having a front link mounted pivotally on the support of the base and having an upper end, a lower end and an intermediate pivot formed between the upper end and the lower end and mounted rotatably on the outer end of one of the cranks of the flywheel;

a rear link mounted pivotally on the support of the base and having an upper end;

a lower end;

an intermediate pivot formed between the upper end and the lower end of the rear link and mounted rotatably on the support; and a lower joint mounted securely on the rear link;

an upper coupler connected pivotally between the upper ends of the front and rear links; and two lower links connected pivotally to the lower ends of the respective front and rear links, protruding backwards from the lower end of the rear links and having rear ends; two pedals mounted on the rear ends of the respective lower links; and two handle assemblies mounted pivotally on the support of the base and pivotally connected respectively to and corresponding respectively to the rear links.

2. The elliptical trainer as claimed in claim 1, wherein each handle assembly has a handle mounted pivotally on the support;

a linking bar formed on and protruding perpendicularly from the handle and having an upper joint mounted securely on the linking bar; and a connection link connected pivotally between the upper joint and the lower joint of a corresponding rear link.

3. The elliptical trainer as claimed in claim 2, wherein:

the support has a front frame mounted on and protruding upwards from the bottom frame;

a rear frame mounted on and protruding upwards from the bottom frame; and a top frame mounted between the front frame and rear frame;

the axle of the flywheel is mounted on the top frame;

each intermediate pivot of each rear link is mounted rotatably on the rear frame; and each handle is mounted pivotally on the rear frame.

4. The elliptical trainer as claimed in claim 3, wherein:

the lower joint of each rear link is a ball joint;

the upper joint of the linking bar of each handle assembly is a ball joint; and the connecting rod of each handle assembly has two ends and two mounted holes defined respectively through the ends and rotatably and respectively receiving the ball joints of a corresponding linking bar and the corresponding rear link.

5. The elliptical trainer as claimed in claim 4, wherein:

the support further has two brackets mounted between the front and rear frames;

the elliptical trainer further has a magnetic wheel mounted rotatably on the brackets of the support of the base and having a pivot shaft mounted on the brackets; and a belt being looped and mounted around the flywheel and the pivot shaft.

6. The elliptical trainer as claimed in claim 5 further comprising a control panel assembly mounted on the securely on the support of the base and controlling and monitoring the rotation of the flywheel and the magnetic wheel.

7. The elliptical trainer as claimed in claim 6, wherein the flywheel further has a bearing mounted securely on the top frame and rotatably receiving the axle of the flywheel.

* * * * *